US010839730B2

(12) United States Patent
Jeon et al.

(10) Patent No.: US 10,839,730 B2
(45) Date of Patent: Nov. 17, 2020

(54) COMMUNICATION DEVICE, DISPLAY DEVICE TEST SYSTEM USING THE SAME, AND DISPLAY DEVICE TEST METHOD USING THE COMMUNICATION DEVICE

(71) Applicant: Samsung Display Co., Ltd., Yongin-Si (KR)

(72) Inventors: Jinyoung Jeon, Gumi-si (KR); Eunsol Seo, Yongin-si (KR); Heonseok Lee, Suwon-si (KR); Taejoon Kim, Seongnam-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 16/566,549

(22) Filed: Sep. 10, 2019

(65) Prior Publication Data

US 2020/0126463 A1 Apr. 23, 2020

(30) Foreign Application Priority Data

Oct. 18, 2018 (KR) ..... 10-2018-0124524

(51) Int. Cl.
*G09G 3/00* (2006.01)
*G09G 3/3225* (2016.01)

(52) U.S. Cl.
CPC ..... *G09G 3/006* (2013.01); *G09G 3/3225* (2013.01)

(58) Field of Classification Search
CPC ..... G06F 3/0412; G06F 3/0416; G06F 3/044; G09G 3/3688; G09G 3/3677; G09G 3/3225; G04G 3/006
See application file for complete search history.

(56) References Cited

U.S. PATENT DOCUMENTS

| | | | | |
|---|---|---|---|---|
| 7,868,868 | B2 | 1/2011 | Kim et al. | |
| 7,944,233 | B1 | 5/2011 | Lee | |
| 9,819,518 | B2 | 11/2017 | Ikenaga | |
| 2011/0193854 | A1* | 8/2011 | Lee | G06F 1/10 345/214 |
| 2019/0035323 | A1* | 1/2019 | Jian | G09G 3/2092 |
| 2019/0204968 | A1* | 7/2019 | Hur | G06F 3/0412 |

FOREIGN PATENT DOCUMENTS

| | | | |
|---|---|---|---|
| JP | 6341852 | B2 | 6/2018 |
| KR | 10-1045071 | B1 | 6/2011 |
| KR | 10-1074417 | B1 | 10/2011 |
| KR | 10-2015-0021616 | A | 3/2015 |

* cited by examiner

*Primary Examiner* — Janice N Tieu

(74) *Attorney, Agent, or Firm* — Innovation Counsel LLP

(57) ABSTRACT

A communication device includes a first device connected to a data line and a clock line and a second device configured to communicate with the first device via the data line and the clock line. A data signal transmitted to the second device from the first device via the data line swings between a first voltage and a second voltage, the second voltage has a voltage level higher than a voltage level of the first voltage, and a clock signal transmitted to the second device from the first device via the clock line is transited to a third voltage higher than the second voltage at a rising edge and then changed to the second voltage.

18 Claims, 10 Drawing Sheets

COMMUNICATION DEVICE, DISPLAY DEVICE TEST SYSTEM USING THE SAME, AND DISPLAY DEVICE TEST METHOD USING THE COMMUNICATION DEVICE

CROSS-REFERENCE TO RELATED APPLICATION

This application claims priority to and the benefit of Korean Patent Application No. 10-2018-0124524, filed on Oct. 18, 2018 in the Korean Intellectual Property Office, the content of which is hereby incorporated by reference in its entirety.

BACKGROUND

1. Field

Aspects of embodiments of the present disclosure relate to a communication device, a display device test system using the communication device, and a display device test method using the communication device.

2. Description of the Related Art

An organic light emitting display device displays an image using an organic light emitting diode, which is a self-luminous element, and is spotlighted as a next generation display device because the organic light emitting display device has superior brightness and color purity. The organic light emitting display device includes red pixels, green pixels, and blue pixels to form a display panel and displays a variety of color images through the display panel.

The organic light emitting display device includes an electronic panel including a display panel that displays the image and an input sensor that senses an external input and outputs information about a position and an intensity of the external input.

A process of testing the display panel and the input sensor in the organic light emitting display device is performed after the manufacturing of the organic light emitting display device is finished to check whether or not the organic light emitting display device is normally operated.

A test circuit that tests the display panel and the input sensor is connected to a computer system through a communication interface. Signals propagated through the communication interface are attenuated due to noise caused by an operating environment of the test circuit and the computer system.

SUMMARY

According to an aspect of embodiments of the present disclosure provides a communication device capable of performing stable communication.

According to an aspect of embodiments of the present disclosure provides a display device test system capable of performing stable communication.

According to an aspect of embodiments of the present disclosure provides a display device test method capable of performing stable communication.

According to one or more embodiments of the inventive concept provide a communication device including a first device connected to a data line and a clock line and a second device connected to the first device via the data line and the clock line to communicate with the first device. A data signal transmitted to the second device from the first device via the data line swings between a first voltage and a second voltage, the second voltage has a voltage level higher than a voltage level of the first voltage, and a clock signal transmitted to the second device from the first device via the clock line swings between a third voltage higher than the second voltage and the first voltage, the clock signal transmitted to the second device from the first device via the clock line being the third voltage at a rising edge and then changed to the second voltage.

The first device includes a voltage controller receiving the first voltage, the second voltage, and the third voltage and outputting a clock high voltage, a data high voltage, a clock low voltage, and a data low voltage in response to a first voltage selection signal and an internal circuit receiving the clock high voltage, the data high voltage, the clock low voltage, and the data low voltage and outputting the first voltage selection signal, the data signal, and the clock signal.

The internal circuit outputs the data signal that swings between the data high voltage and the data low voltage.

The internal circuit outputs the clock signal that swings between the clock high voltage and the clock low voltage.

The internal circuit sequentially outputs the first voltage selection signal having a first signal level to select the third voltage at a rising edge of the clock signal and the first voltage selection signal having a second signal level to select the second voltage.

The voltage controller includes a first switching transistor including a first electrode receiving the second voltage, a second electrode connected to the first node, and a gate electrode receiving the first voltage selection signal, a first inverter including an input terminal receiving the first voltage selection signal and an output terminal, and a second switching transistor including a first electrode receiving the third voltage, a second electrode connected to the first node, and a gate electrode connected to the output terminal of the first inverter, and a voltage of the first node is the clock high voltage.

The voltage controller outputs the second voltage as the data high voltage.

The voltage controller outputs the first voltage as the data low voltage and the clock low voltage.

The clock signal transmitted to the second device from the first device via the clock line is transited to a fourth voltage lower than the first voltage at a falling edge and then changed to the first voltage.

The voltage controller further receives the fourth voltage and a second voltage selection signal, and the internal circuit further outputs the second voltage selection signal.

The voltage controller includes a second inverter including an input terminal receiving the second voltage selection signal and an output terminal, a third switching transistor including a first electrode receiving the fourth voltage, a second electrode connected to a second node, and a gate electrode connected to the output terminal of the second inverter, and a fourth switching transistor including a first electrode receiving the first voltage, a second electrode connected to the first node, and a gate electrode connected to the second voltage selection signal, and a voltage of the second node is the clock low voltage.

The data signal transmitted to the second device from the first device via the data line is transited to a third voltage higher than the second voltage at the rising edge and then changed to the second voltage.

The clock signal transmitted to the second device from the first device via the clock line is transited to a fourth voltage lower than the first voltage at the falling edge and then changed to the first voltage.

The first voltage is about 0 volts, the second voltage is about 1.8 volts, and third voltage is about 3.3 volts.

Embodiments of the inventive concept provide a test system including a test circuit testing a display panel, and a computer device connected to the test circuit via a data line and a clock line to communicate with the test circuit. A data signal transmitted to the test circuit from the computer device via the data line swings between a first voltage and a second voltage, the second voltage has a voltage level higher than a voltage level of the first voltage, and a clock signal transmitted to the test circuit from the computer device via the clock line swings between a third voltage higher than the second voltage and the first voltage, the clock signal transmitted to the test circuit from the computer device via the clock line being the third voltage at a rising edge and then changed to the second voltage.

The computer device includes a voltage controller receiving the first voltage, the second voltage, and the third voltage and outputting a clock high voltage, a data high voltage, a clock low voltage, and a data low voltage in response to a first voltage selection signal and an internal circuit receiving the clock high voltage, the data high voltage, the clock low voltage, and the data low voltage and outputting the first voltage selection signal, the data signal, and the clock signal.

The internal circuit outputs the data signal that swings between the data high voltage and the data low voltage and outputs the clock signal that swings between the clock high voltage and the clock low voltage.

The internal circuit sequentially outputs the first voltage selection signal having a first signal level to select the third voltage at the rising edge of the clock signal and the first voltage selection signal having a second signal level to select the second voltage.

Embodiments of the inventive concept provide a method of testing a display panel using a test system, which includes a first device and a second device connected to the first device to communicate with the first device via a data line and a clock line, the method comprising, including transmitting a clock signal to the second device from the first device via the clock line and transmitting a test data signal to the second device from the first device via the data line. The test data signal swings between a first voltage and a second voltage, the second voltage has a voltage level higher than a voltage level of the first voltage, and the clock signal swings between a third voltage higher than the second voltage and the first voltage, the clock signal transmitted to the second device from the first device via the clock line being the third voltage at a rising edge and then changed to the second voltage.

The clock signal is transited to a fourth voltage lower than the first voltage at a falling edge and then changed to the first voltage.

According to the above, the clock signal and/or the data signal, which is transmitted to the second device from the first device of the communication device, increases the voltage level of the clock signal to the third voltage higher than the second voltage, which is a normal level, and is transited to the second voltage at the rising edge. Thus, the signal distortion caused by the noise may be reduced.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
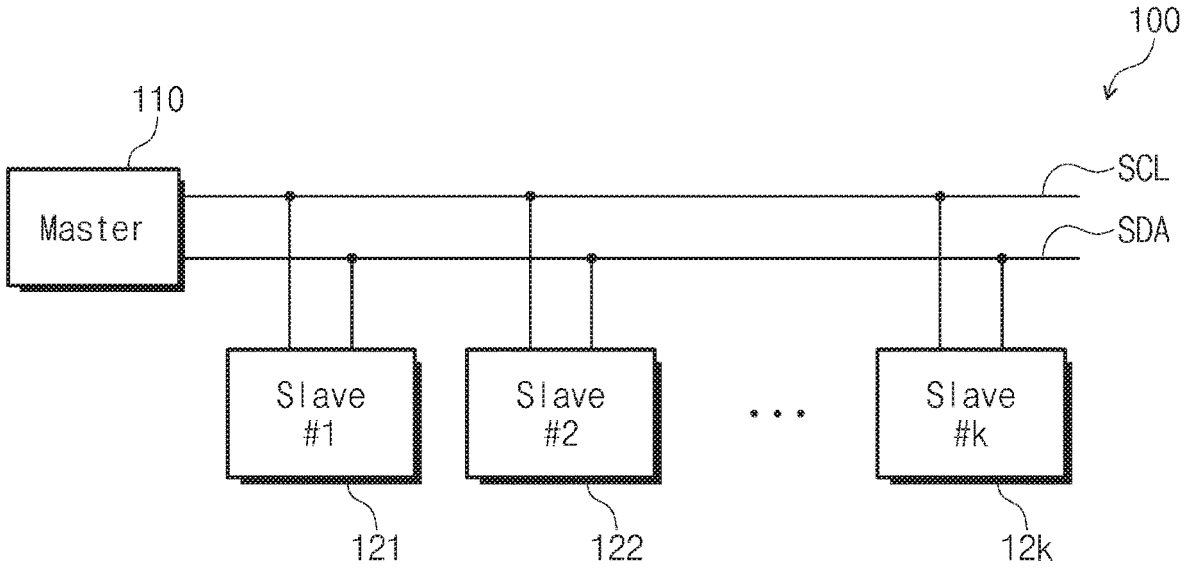
FIG. 1 is a block diagram showing a communication device according to an exemplary embodiment of the present disclosure.

It will be understood that when an element or layer is referred to as being "on", "connected to" or "coupled to" another element or layer, it can be directly on, connected or coupled to the other element or layer or intervening elements or layers may be present.

Like numerals refer to like elements throughout. In the drawings, the thickness of layers, films, and regions are exaggerated for clarity.

As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure. As used herein, the singular forms, "a", "an" and "the" are intended to include the plural forms as well, unless the context clearly indicates otherwise.

Spatially relative terms, such as "beneath", "below", "lower", "above", "upper" and the like, may be used herein for ease of description to describe one element or feature's relationship to another element(s) or feature(s) as illustrated in the figures.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Hereinafter, the present disclosure will be explained in detail with reference to the accompanying drawings.

FIG. 1 is a block diagram showing a communication device 100 according to an exemplary embodiment of the present disclosure.

Referring to FIG. 1, the communication device 100 includes a master device 110 and a plurality of slave devices 121 to 12*k*. The communication device 100 further includes a data line SDA and a clock line SCL. The master device 110 and the slave devices 121 to 12*k* are connected to the data line SDA and the clock line SCL.

The master device 110 and the slave devices 121 to 12*k* perform a data communication with each other via the data line SDA and the clock line SCL. For example, the data communication may be an inter-integrated circuit (that is called $I^2C$ or IIC) communication.

The master device 110 may output a data signal to the data line SDA. The master device 110 may occupy the data line SDA while outputting the data signal to the data line SDA. When the master device 110 occupies the data line SDA, the master device 110 may be in an output state with respect to the data line SDA. That is, the master device 110 may provide the data signal to the data line SDA. In this case, the slave devices 121 to 12*k* may release occupancy of the data line SDA.

When the slave devices 121 to 12*k* release the occupancy of the data line SDA, the slave devices 121 to 12*k* may be in an input state with respect to the data line SDA. That is, the slave devices 121 to 12*k* may receive the data signal from the data line SDA.

Different from the above, one of the slave devices 121 to 12*k* may output the data signal to the data line SDA. One of the slave devices 121 to 12*k* may occupy the data line SDA while outputting the data signal to the data line SDA. When one of the slave devices 121 to 12*k* occupies the data line SDA, the one of the slave devices 121 to 12*k* may be in the output state with respect to the data line SDA. That is, the one of the slave devices 121 to 12*k* may provide the data signal to the data line SDA. In this case, the master device 110 may release the occupancy with respect to the data line SDA. When the master device 110 releases the occupancy with respect to the data line SDA, the master device 110 may be in the input state with respect to the data line SDA. That is, the master device 110 may receive the data signal from the data line SDA.

The master device 110 may output a clock signal to the clock line SCL. The master device 110 may occupy the clock line SCL while outputting the clock signal to the clock line SCL. When the master device 110 occupies the clock line SCL, the master device 110 may be in an output state with respect to the clock line SCL. That is, the master device 110 may provide the clock signal to the clock line SCL. In this case, the slave devices 121 to 12*k* may release the occupancy of the clock line SCL. When the slave devices 121 to 12*k* release the occupancy of the clock line SCL, the slave devices 121 to 12*k* may be in an input state with respect to the clock line SCL. That is, the slave devices 121 to 12*k* may receive the clock signal from the clock line SCL.

Different from the above, one of the slave devices 121 to 12*k* may output the clock signal to the clock line SCL. One of the slave devices 121 to 12*k* may occupy the clock line SCL while outputting the clock signal to the clock line SCL. When one of the slave devices 121 to 12*k* occupies the clock line SCL, the one of the slave devices 121 to 12*k* may be in the output state with respect to the clock line SCL. That is, the one of the slave devices 121 to 12*k* may provide the clock signal to the clock line SCL. In this case, the master device 110 may release the occupancy with respect to the clock line SCL. When the master device 110 releases the occupancy with respect to the clock line SCL, the master device 110 may be in the input state with respect to the clock line SCL. The master device 110 may receive the clock signal from the clock line SCL.

The data communication performed between the master device 110 and one slave device among the slave devices 121 to 12*k* will be described in detail with reference to FIG. 2.

Figure 2:
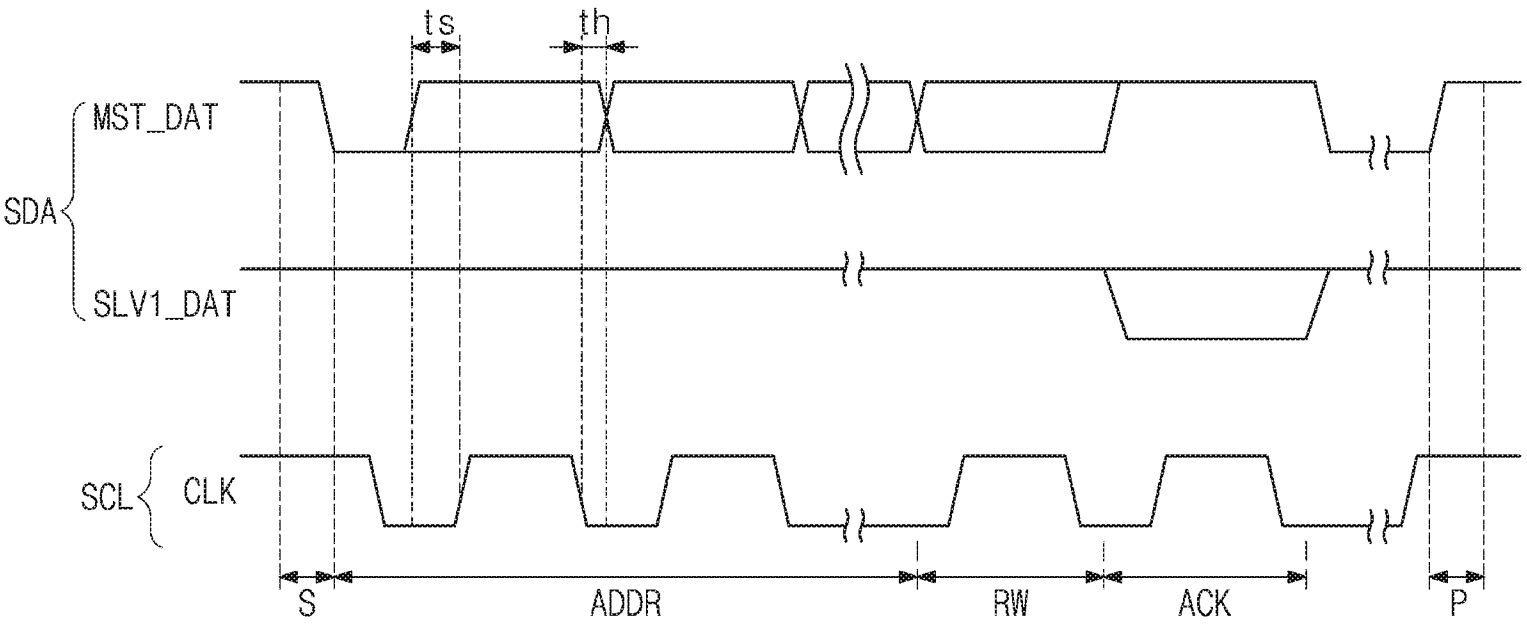
FIG. 2 is a waveform diagram showing signals transmitted and received between components of a communication device according to an exemplary embodiment of the present disclosure.

FIG. 2 is a waveform diagram showing signals transmitted and received between components of the communication device according to an exemplary embodiment of the present disclosure. In the present exemplary embodiment, the communication between the master device 110 and the slave device 121 will be described as a representative example. In FIG. 2, a master data signal MST_DAT transmitted to the slave device 121 from the mater device 110 and a slave data signal SLV1_DAT transmitted to the master device 110 from the slave device 121 are independently shown, however, the master data signal MST_DAT and the slave data signal SLV1_DAT are transmitted via the data line SDA.

Referring to FIGS. 1 and 2, the master device 110 outputs a start signal S to start the communication with the slave device 121. The start signal S may change a signal transmitted through the data line SDA from a high level to a low level while the clock signal CLK transmitted through the clock line SCL is at a high level. The master device 110 outputs a device address signal ADDR to the slave device 121. For exempla, the device address signal ADDR may be a 7-bit signal. In the present exemplary embodiment, the device address signal ADDR may designate the slave device 121. Then, the master device 110 outputs a read/write signal RW to the slave device 121. The slave device 121 transmits an acknowledge signal ACK to the master device 110 in response to the device address signal ADDR and the read/write signal RW from the master device 110.

The master device 110 changes signal transmitted through the data line SDA to the high level from the low level while the clock signal CLK is at high level to transmit a termination signal P.

The signals transmitted through the data line SDA should not be changed when the clock signal CLK is at high level in the communication between the master device 110 and the slave device 121. Accordingly, a data setup time ts and a data hold time th are required. By the above-mentioned manner, the master device 110 or the slave device 121 may stably read the signals transmitted through the data line SDA when the clock signal CLK is at high level. Exceptionally, the master device 110 may change the data line SDA to the low level from the high level to transmit the start signal S when the clock signal CLK is at high level and may change the data line SDA to the high level from the low level to transmit the termination signal P when the clock signal CLK is at high level.

Figure 3:
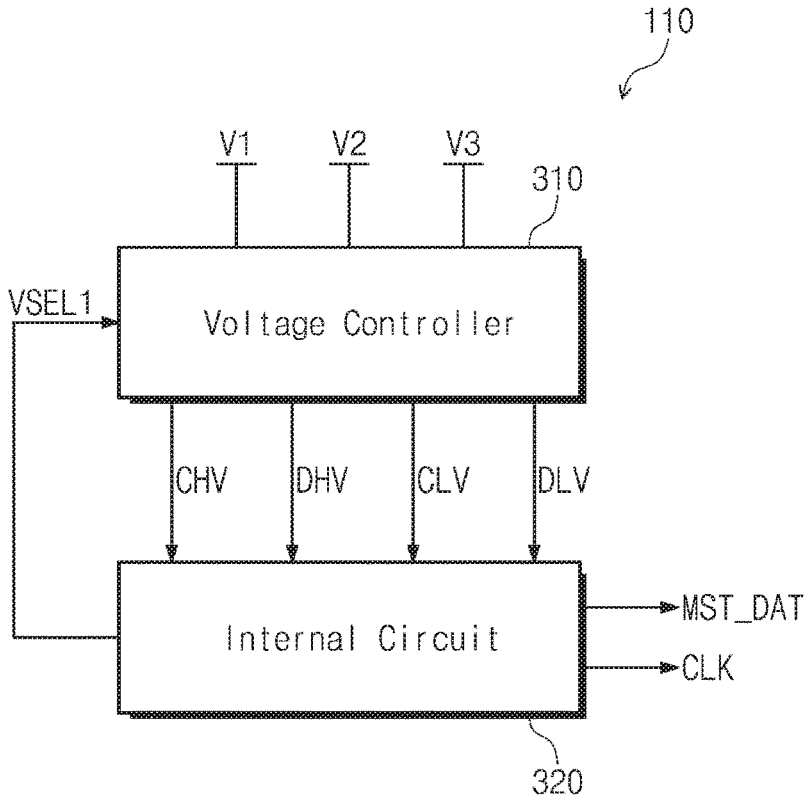
FIG. 3 is a block diagram showing a circuit configuration of a master device according to an exemplary embodiment of the present disclosure.

FIG. 3 is a block diagram showing a circuit configuration of the master device 110 according to an exemplary embodiment of the present disclosure. FIG. 3 shows only a circuit block related to the communication of the master device, however, the master device may further include other circuit components, e.g., a test signal generator or a clock generator. In addition, FIG. 3 shows only the master device, however, the slave devices 121 to 12*k* shown in FIG. 1 may include a circuit configuration similar to that of the master device shown in FIG. 3.

Referring to FIG. 3, the master device 110 includes a voltage controller 310 and an internal circuit 320. The voltage controller 310 receives a first voltage V1, a second voltage V2, and a third voltage V3. The voltage controller 310 outputs a clock high voltage CHV, a data high voltage DHV, a clock low voltage CLV, and a data low voltage DLV in response to a first voltage selection signal VSEL1. In the present exemplary embodiment, the first voltage V1, the second voltage V2, and the third voltage V3 have different voltage levels from each other and are in a relation of V1<V2<V3.

The voltage controller 310 outputs one of the second voltage V2 and the third voltage V3 as the clock high voltage CHV in response to the first voltage selection signal VSEL1. The voltage controller 310 outputs the second voltage V2 as the data high voltage DHV. The voltage controller 310 outputs the first voltage V1 as the clock low voltage CLV and the data low voltage DLV.

The internal circuit 320 receives the clock high voltage CHV, the data high voltage DHV, the clock low voltage CLV, and the data low voltage DLV from the voltage controller 310. The internal circuit 320 outputs the first voltage selection signal VSEL1 to the voltage controller 310 and outputs the master data signal MST_DAT and the clock signal CLK.

The internal circuit 320 outputs the mater data signal MST_DAT that swings between the data high voltage DHV and the data low voltage DLV. In addition, the internal circuit 320 outputs the clock signal CLK that swings between the clock high voltage CHV and the clock low voltage CLV.

The master data signal MST_DAT and the clock signal CLK may be transmitted to the slave devices 121 to 12*k* shown in FIG. 1 via the data line SDA and the clock line SCL.

Figure 4:
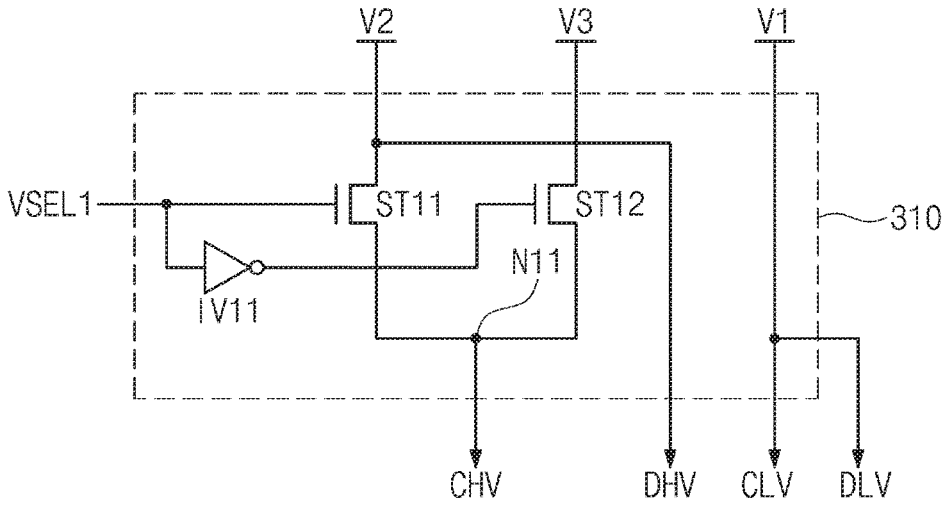
FIG. 4 is a circuit diagram showing a voltage controller in a master device according to an exemplary embodiment of the present disclosure.

FIG. 4 is a circuit diagram showing the voltage controller 310 in the master device according to an exemplary embodiment of the present disclosure.

Referring to FIG. 4, the voltage controller 310 includes a first switching transistor ST11, a second switching transistor ST12, and a first inverter IV11.

The first switching transistor ST11 includes a first electrode receiving the second voltage V2, a second electrode connected to a first node N11, and a gate electrode receiving the first voltage selection signal VSEL1.

The first inverter IV11 includes an input terminal receiving the first voltage selection signal VSEL1 and an output terminal.

The second switching transistor ST12 includes a first electrode receiving the third voltage V3, a second electrode connected to the first node N11, and a gate electrode connected to the output terminal of the first inverter IV11.

For example, when the first voltage selection signal VSEL1 is at high level, the first switching transistor ST11 is turned on, the second switching transistor ST12 is turned off, and thus the second voltage V2 is applied to the first node N11. When the first voltage selection signal VSEL1 is at low level, the first switching transistor ST11 is turned off, the second switching transistor ST12 is turned on, and thus the third voltage V3 is applied to the first node N11.

A voltage of the first node N11 is output as the clock high voltage CHV. The voltage controller 310 outputs the second voltage V2 as the data high voltage DHV. The voltage controller 310 outputs the first voltage V1 as the clock low voltage CLV and the data low voltage DLV.

Figure 5:
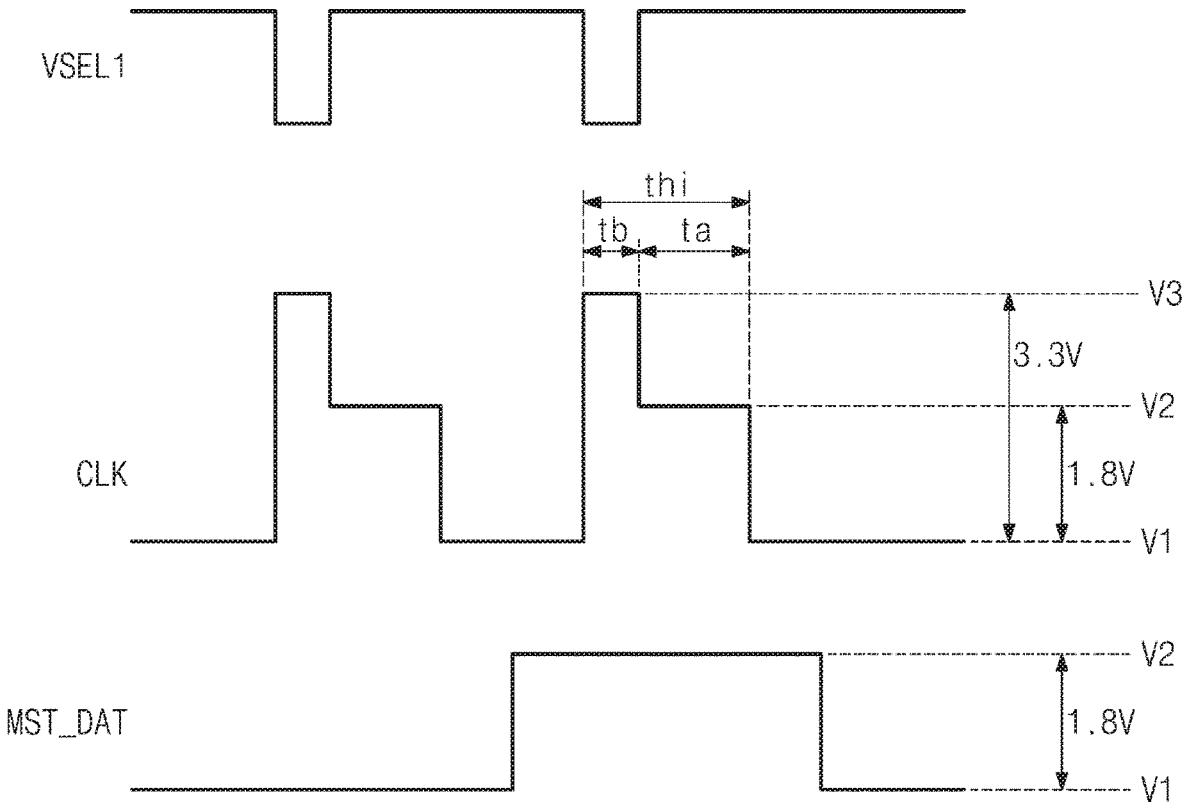
FIG. 5 is a timing diagram showing a clock signal and a master data signal, which are output from the master device including the voltage controller shown in FIG. 4.

FIG. 5 is a timing diagram showing the clock signal CLK and the master data signal MST_DAT, which are output from the master device 110 including the voltage controller 310 shown in FIG. 4.

Referring to FIGS. 3 to 5, because the data high voltage DHV is the second voltage V2 and the data low voltage DLV is the first voltage V1, the master data signal MST_DAT output from the internal circuit 320 is a signal that swings between the first voltage V1 and the second voltage V2. For example, when the first voltage V1 is about 0 volts and the second voltage V2 is about 1.8 volts, a peak-to-peak voltage Vpp between the first voltage V1 and the second voltage V2 is about 1.8 volts.

Because the clock low voltage CLV is the first voltage V1, the low level of the clock signal CLK output from the internal circuit 320 is the first voltage V1. The internal circuit 320 outputs the first voltage selection signal VSEL1 having the low level at a rising edge of the clock signal CLK, at which the clock signal CLK is transited to the high level from the low level. When the first voltage selection signal VSEL1 is at low level, the first switching transistor ST11 is turned off, the second switching transistor ST12 is turned on, and thus the third voltage V3 is applied to the first node N11. Therefore, the clock high voltage CHV may be set to the third voltage V3 at the rising edge of the clock signal CLK. When a certain boosting period tb elapses, the internal circuit 320 changes the first voltage selection signal VSEL1 to the high level. Because the first voltage selection signal VSEL1 is changed to the high level, the first switching transistor ST11 is turned on, the second switching transistor ST12 is turned off, and thus the second voltage V2 is applied to the first node N11.

Thus, the clock signal CLK may correspond to the third voltage V3 in the boosting period tb of a high level period Thi of the clock signal CLK, and the clock signal CLK may correspond to the second voltage V2 in a normal period ta of the high level period Thi of the clock signal CLK. In the present exemplary embodiment, the boosting period tb and the normal period ta have a relation of tb<ta, however, they should not be limited thereto or thereby.

As an example, the first voltage V1 is about 0 volts, the second voltage V2 is about 1.8 volts, and the third voltage V3 is about 3.3 volts, however, they should not be limited thereto or thereby. In this case, a peak-to-peak voltage Vpp between the first voltage V1 and the third voltage V3 is about 3.3 volts. According to another embodiment, the first voltage V1 is about 0 volts, the second voltage V2 is about 3.3 volts, and the third voltage V3 is about 5 volts.

As described above, the master device 110 or the slave device 121 may identify the data signal transmitted via the data line SDA when the clock signal CLK is at high level. However, the clock signal CLK may be distorted due to a signal attenuation when a length of the clock line SCL between the master device 110 and the slave devices 121 to 12*k* shown in FIG. 1 becomes longer or a noise caused by an operation environment. When the data setup time ts and the data hold time th shown in FIG. 2 are not sufficiently secured, the clock signal CLK transmitted via the clock line SCL and the master data signal MST_DAT transmitted via the data line SDA or the slave data signals SLV1_DAT transmitted via the data line SDA are not synchronized with each other due to the distortion or noise of the clock signal CLK. In this case, it is difficult to normally perform the communication between the master device 110 and the slave devices 121 to 12*k*. In addition, because the master device 110 is required to output the same master data signal MST_DAT repeatedly to the slave device 121 to 12*k* until the slave devices 121 to 12*k* respond, a communication speed may be lowered.

The voltage controller 310 of the master device 110 according to an exemplary embodiment of the present disclosure sets the high level of the clock signal CLK to the third voltage V3 which is higher than the second voltage V2 at the rising edge of the clock signal CLK. Accordingly, although the clock signal CLK is slightly attenuated or delayed while being transmitted to the slave devices 121 to 12*k* via the clock line SCL, the clock signal CLK may be compensated by the boosted voltage.

Figure 6:
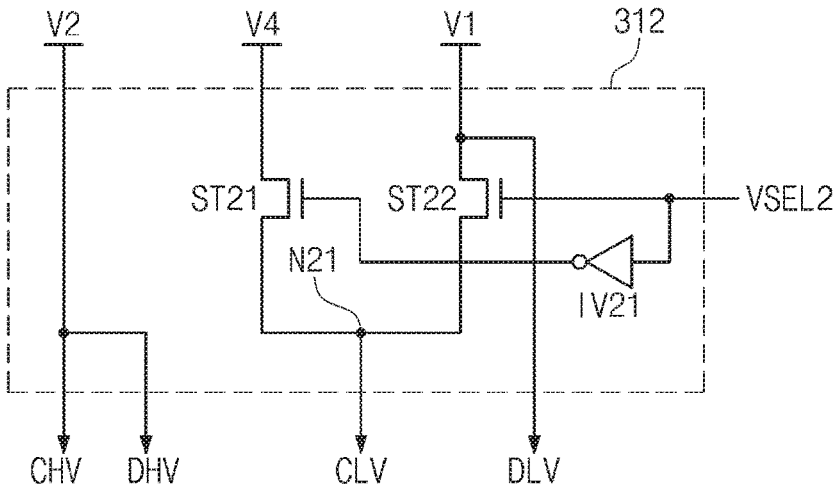
FIG. 6 is a circuit diagram showing a voltage controller in a master device according to an exemplary embodiment of the present disclosure.

FIG. 6 is a circuit diagram showing a voltage controller 312 in a master device according to an exemplary embodiment of the present disclosure.

Referring to FIG. 6, the voltage controller 312 includes a third switching transistor ST21, a fourth switching transistor ST22, and a second inverter IV21.

The third switching transistor ST21 includes a first electrode receiving a fourth voltage V4, a second electrode connected to a second node N21, and a gate electrode receiving an inverted second voltage selection signal from the inverter IV21.

The second inverter IV21 includes an input terminal receiving the second voltage selection signal VSEL2 and an output terminal outputs the inverted second voltage selection signal to the gate electrode of the third switching transistor ST21.

The fourth switching transistor ST22 includes a first electrode receiving the first voltage V1, a second electrode connected to the second node N21, and a gate electrode receiving a second voltage selection signal VSEL2.

For example, when the second voltage selection signal VSEL2 is at high level, the fourth switching transistor ST22 is turned on, the third switching transistor ST21 is turned off, and thus the first voltage V1 is applied to the second node N21. When the second voltage selection signal VSEL2 is at low level, the fourth switching transistor ST22 is turned off, the third switching transistor ST21 is turned on, and thus the fourth voltage V4 is applied to the second node N21.

A voltage of the second node N21 is output as the clock low voltage CLV. The voltage controller 312 outputs the first voltage V1 as the data low voltage DLV. The voltage controller 312 outputs the second voltage V2 as the clock high voltage CHV and the data high voltage DHV.

Figure 7:
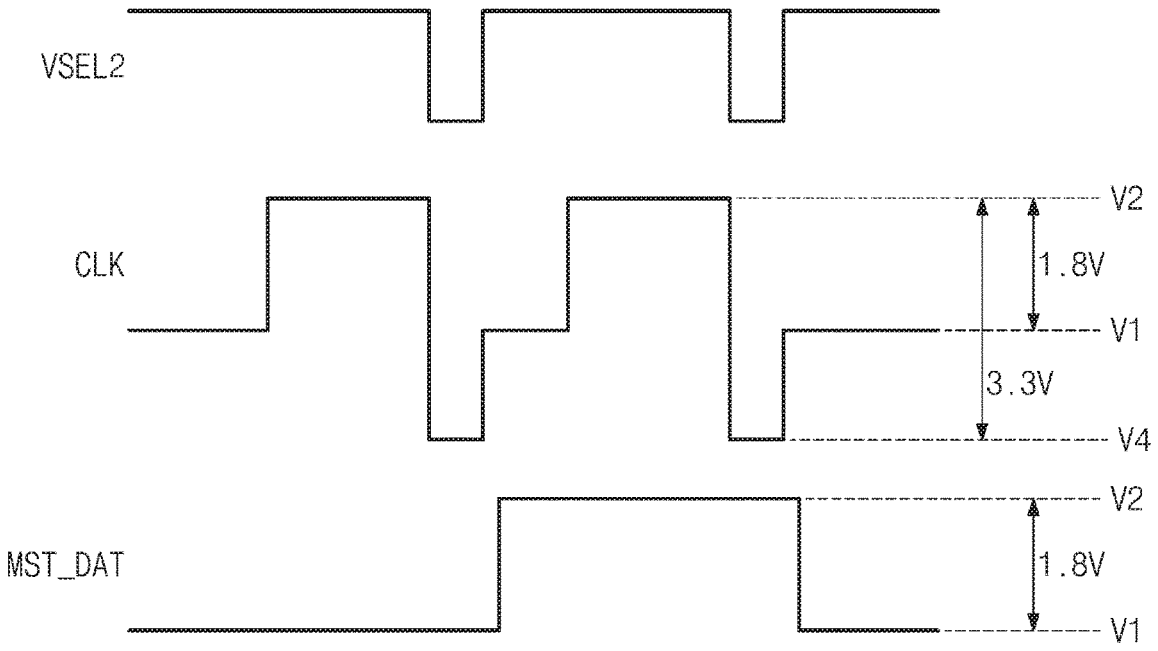
FIG. 7 is a timing diagram showing a clock signal and a master data signal, which are output from the master device including the voltage controller shown in FIG. 6.

FIG. 7 is a timing diagram showing a clock signal and a master data signal, which are output from the master device including the voltage controller 312 shown in FIG. 6.

Referring to FIGS. 6 and 7, because the data high voltage DHV is the second voltage V2 and the data low voltage DLV is the first voltage V1, the master data signal MST_DAT output from the internal circuit 320 is a signal that swings between the first voltage V1 and the second voltage V2. For example, when the first voltage V1 is about 0 volts and the second voltage V2 is about 1.8 volts, a peak-to-peak voltage Vpp between the first voltage V1 and the second voltage V2 is about 1.8 volts.

Because the clock high voltage CHV is the second voltage V2, the high level of the clock signal CLK output from the internal circuit 320 is the second voltage V2. The internal circuit 320 shown in FIG. 3 outputs the second voltage selection signal VSEL2 having the low level at a falling edge of the clock signal CLK, at which the clock signal CLK is transited to the low level from the high level. When the second voltage selection signal VSEL2 is at low level, the fourth switching transistor ST22 is turned off, the third switching transistor ST21 is turned on, and thus the fourth voltage V4 is applied to the second node N21. Therefore, the clock low voltage CLV may be set to the fourth voltage V4 at the falling edge of the clock signal CLK. When a certain time period elapses, the internal circuit 320 changes the second voltage selection signal VSEL2 to the high level.

Because the second voltage selection signal VSEL2 is changed to the high level, the fourth switching transistor ST22 is turned on, the third switching transistor ST21 is turned off, and thus the first voltage V1 is applied to the second node N21.

Thus, the clock signal CLK may be changed to the first voltage V1 from the fourth voltage V4 during the low level period of the clock signal CLK. In the exemplary embodiment, the first voltage V1 is about 0 volts, the second voltage V2 is about 1.8 volts, and the fourth voltage V4 is about −1.5 volts. In this case, a peak-to-peak voltage Vpp between the second voltage V2 and the fourth voltage V4 is about 3.3 volts. However, the voltage level of each of the first voltage V1, the second voltage V2, and the fourth voltage V4 should not be limited thereto or thereby.

The voltage controller 312 of the master device 110 according to an exemplary embodiment of the present disclosure sets the low level of the clock signal CLK to the fourth voltage V4 lower than the first voltage V1 that is a normal level at the falling edge of the clock signal CLK. Accordingly, although the clock signal CLK is slightly delayed while being transmitted to the slave devices 121 to 12*k* via the clock line SCL, the clock signal CLK may be rapidly discharged.

Figure 8:
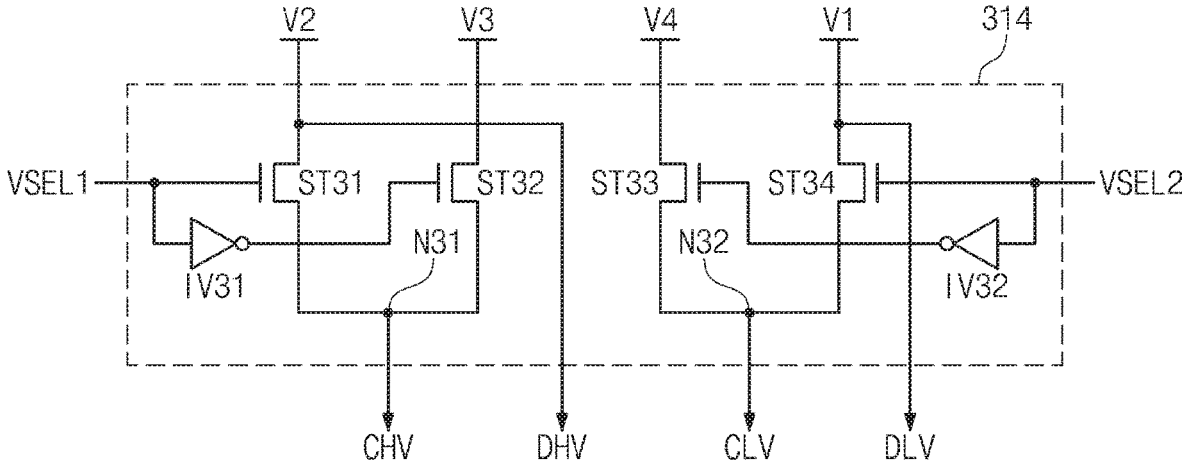
FIG. 8 is a circuit diagram showing a voltage controller in a master device according to an exemplary embodiment of the present disclosure.

FIG. 8 is a circuit diagram showing a voltage controller 314 in a master device according to an exemplary embodiment of the present disclosure.

Referring to FIG. 8, the voltage controller 314 includes first, second, third, and fourth switching transistors ST31, ST32, ST33, and ST34, a first inverter IV31, and a second inverter IV32.

The first switching transistor ST31 includes a first electrode receiving a second voltage V2, a second electrode connected to a first node N31, and a gate electrode receiving a first voltage selection signal VSEL1.

The first inverter IV31 includes an input terminal receiving the first voltage selection signal VSEL1 and an output terminal output an inverted first voltage selection signal.

The second switching transistor ST32 includes a first electrode receiving a third voltage V3, a second electrode connected to the first node N31, and a gate electrode connected to the output terminal of the first inverter IV31 to receive the inverted first voltage selection signal.

The third switching transistor ST33 includes a first electrode receiving a fourth voltage V4, a second electrode connected to a second node N32, and a gate electrode receiving an inverted second voltage selection signal.

The second inverter IV32 includes an input terminal receiving the second voltage selection signal VSEL2 and an output terminal outputting the inverted second voltage selection signal.

The fourth switching transistor ST34 includes a first electrode receiving a first voltage V1, a second electrode connected to the second node N32, and a gate electrode receiving the second voltage selection signal VSEL2.

For example, when the first voltage selection signal VSEL1 is at high level, the first switching transistor ST31 is turned on, the second switching transistor ST32 is turned off, and thus the second voltage V2 is applied to the first node N31. When the first voltage selection signal VSEL1 is at low level, the first switching transistor ST31 is turned off, the second switching transistor ST32 is turned on, and thus the third voltage V3 is applied to the first node N31. The voltage of the first node N31 is output as the clock high voltage CHV. The voltage controller 314 outputs the second voltage V2 as the data high voltage DHV.

For example, when the second voltage selection signal VSEL2 is at high level, the third switching transistor ST33 is turned off, the fourth switching transistor ST34 is turned on, and thus the first voltage V1 is applied to the second node N32. When the second voltage selection signal VSEL2 is at low level, the third switching transistor ST33 is turned on, the fourth switching transistor ST34 is turned off, and thus the fourth voltage V4 is applied to the second node N32. The voltage of the second node N32 is output as the clock low voltage CLV. The voltage controller 314 outputs the first voltage V1 as the data low voltage DLV.

Figure 9:
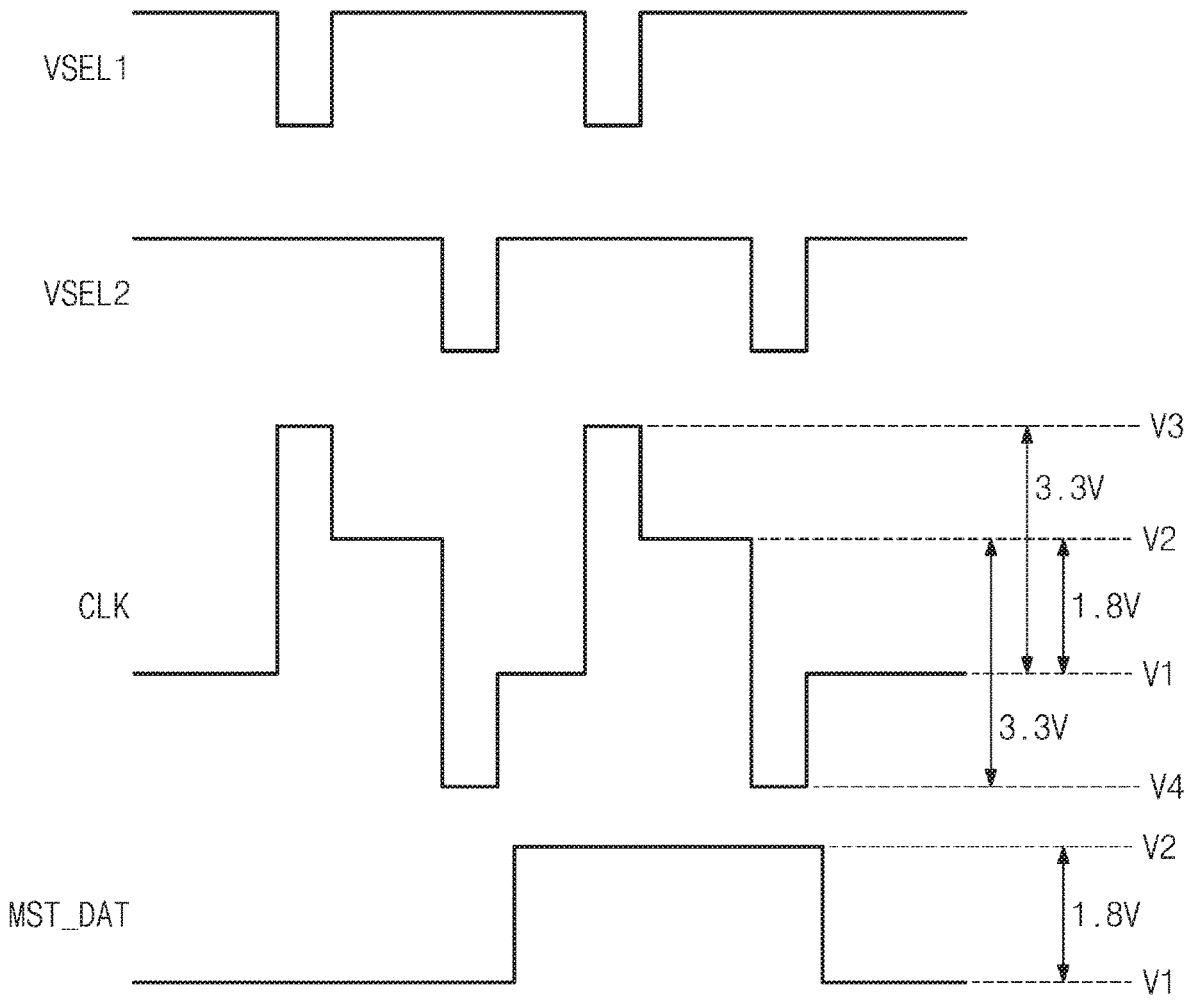
FIG. 9 is a timing diagram showing a clock signal and a master data signal, which are output from the master device including the voltage controller shown in FIG. 8.

FIG. 9 is a timing diagram showing a clock signal and a master data signal, which are output from the master device including the voltage controller shown in FIG. 8.

Referring to FIGS. 8 and 9, the voltage controller 314 outputs one of the second voltage V2 and the third voltage V3 as the clock high voltage CHV in response to the first voltage selection signal VSEL1. In addition, the voltage controller 314 outputs one of the first voltage V1 and the fourth voltage V4 as the clock low voltage CLV in response to the second voltage selection signal VSEL2.

The internal circuit 320 shown in FIG. 3 outputs the third voltage V3 higher than the second voltage V2 having a normal voltage level at the rising edge of the clock signal CLK and then outputs the second voltage V2. That is, the clock signal CLK is changed to the second voltage V2 from the third voltage V3 during the high level period of the clock signal CLK.

The internal circuit 320 shown in FIG. 3 outputs the fourth voltage V4 lower than the first voltage V1 having the normal voltage level at the falling edge of the clock signal CLK and then outputs the first voltage V1. That is, the clock signal CLK is changed to the first voltage V1 from the fourth voltage V4 during the low level period of the clock signal CLK.

For example, when the first voltage V1, the second voltage V2, the third voltage V3, and the fourth voltage V4 are about 0 volts, about 1.8 volts, about 3.3 volts, and −1.5 volts, respectively, a peak-to-peak voltage Vpp between the first voltage V1 and the second voltage V2 is about 1.8 volts, a peak-to-peak voltage Vpp between the first voltage V1 and the third voltage V3 is about 3.3 volts, and a peak-to-peak voltage Vpp between the second voltage V2 and the fourth voltage V4 is about 3.3 volts. However, the voltage level of each of the first, second, third, and fourth voltages V1, V2, V3, and V4 may be changed in various ways.

Figure 10:
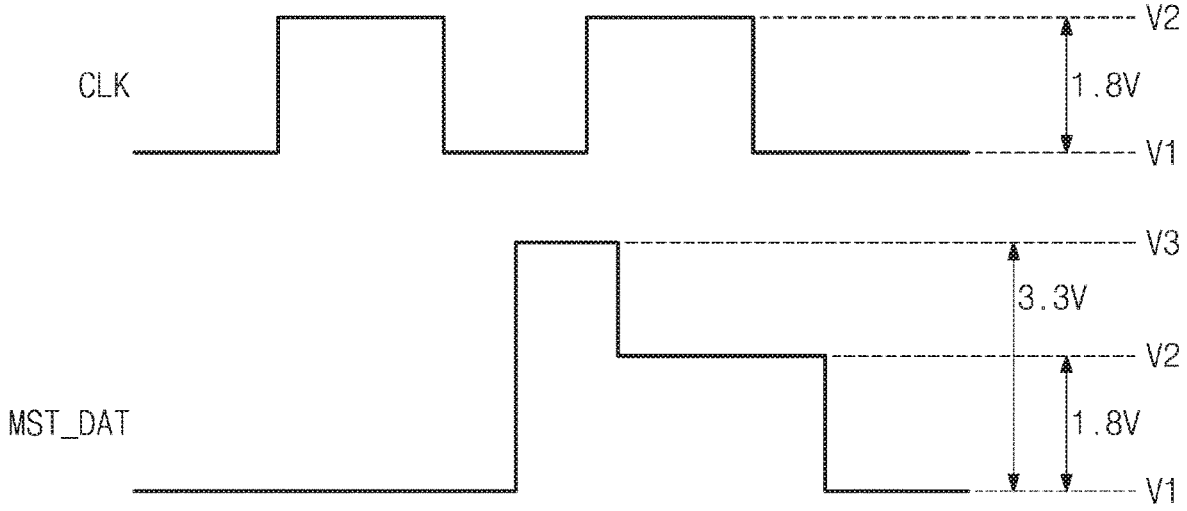
FIG. 10 is a timing diagram showing an example of a clock signal and a master data signal, which are output from the master device shown in FIG. 1.

FIG. 10 is a timing diagram showing an example of a clock signal and a master data signal, which are output from the master device shown in FIG. 1.

Referring to FIG. 10, the clock signal CLK is the signal that swings between the first voltage V1 and the second voltage V2. For example, when the first voltage V1 is about 0 volts and the second voltage V2 is about 1.8 volts, a peak-to-peak voltage Vpp between the first voltage V1 and the second voltage V2 is about 1.8 volts.

The master device 110 outputs the third voltage V3 higher than the second voltage V2 having the normal voltage level at the rising edge of the master data signal MST_DAT and then outputs the second voltage V2. That is, the master data signal MST_DAT is changed to the second voltage V2 from the third voltage V3 during the high level period of the clock signal CLK.

Figure 11:
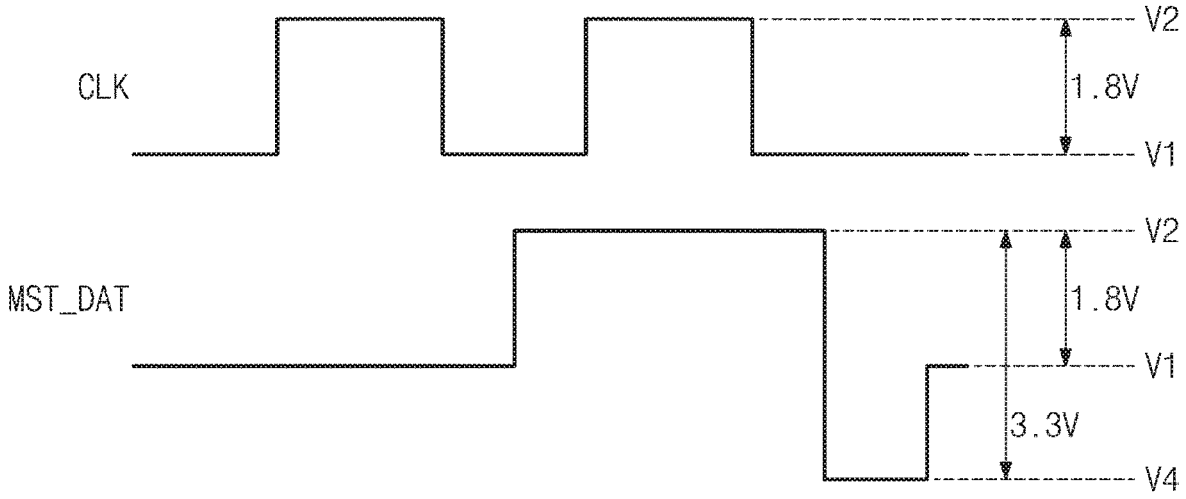
FIG. 11 is a timing diagram showing an example of a clock signal and a master data signal, which are output from the master device shown in FIG. 1.

FIG. 11 is a timing diagram showing an example of a clock signal and a master data signal, which are output from the master device shown in FIG. 1.

Referring to FIG. 11, the clock signal CLK is the signal that swings between the first voltage V1 and the second voltage V2. For example, when the first voltage V1 is about 0 volts and the second voltage V2 is about 1.8 volts, a peak-to-peak voltage Vpp between the first voltage V1 and the second voltage V2 is about 1.8 volts.

The master device 110 outputs the fourth voltage V4 lower than the first voltage V1 having the normal voltage level at the falling edge of the master data signal MST_DAT and then outputs the first voltage V1. That is, the master data signal MST_DAT is changed to the first voltage V1 from the fourth voltage V4 during the low level period of the clock signal CLK.

Figure 12:
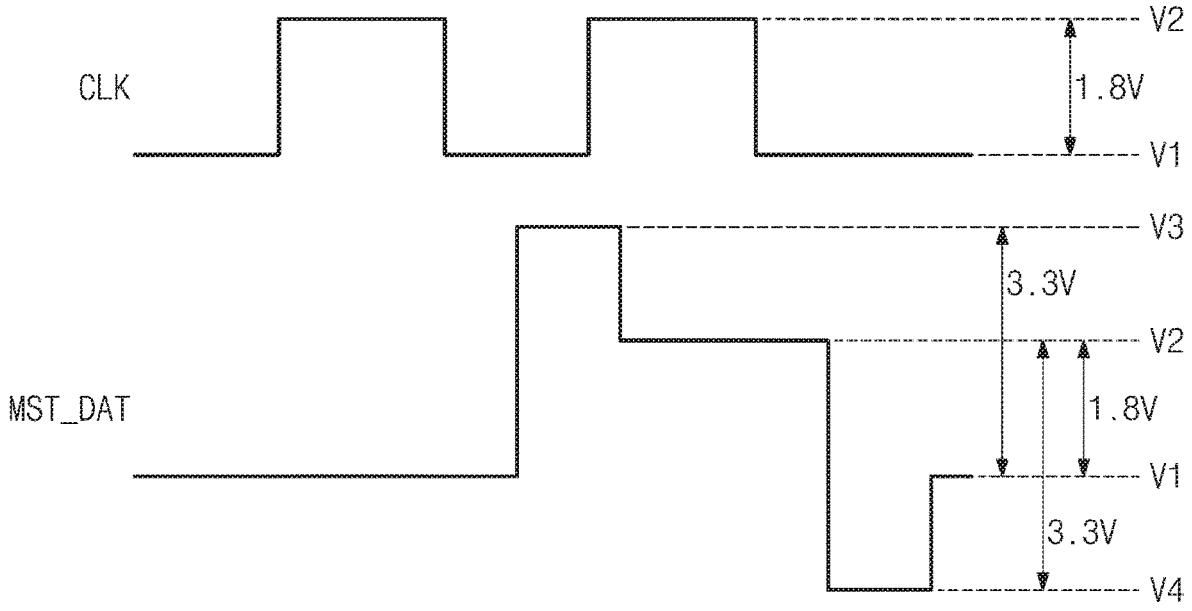
FIG. 12 is a timing diagram showing an example of a clock signal and a master data signal, which are output from the master device shown in FIG. 1.

FIG. 12 is a timing diagram showing an example of a clock signal and a master data signal, which are output from the master device shown in FIG. 1.

Referring to FIG. 12, the clock signal CLK is the signal that swings between the first voltage V1 and the second voltage V2. For example, when the first voltage V1 is about 0 volts and the second voltage V2 is about 1.8 volts, a peak-to-peak voltage between the first voltage V1 and the second voltage V2 is about 1.8 volts.

The master device 110 outputs the third voltage V3 higher than the second voltage V2 having the normal voltage level at the rising edge of the master data signal MST_DAT and then outputs the second voltage V2. That is, the master data signal MST_DAT is changed to the second voltage V2 from the third voltage V3 during the high level period of the clock signal CLK.

In addition, the internal circuit 320 outputs the fourth voltage V4 lower than the first voltage V1 having the normal voltage level at the falling edge of the master data signal MST_DAT and then outputs the first voltage V1. That is, the master data signal MST_DAT is changed to the first voltage V1 from the fourth voltage V4 during the low level period of the clock signal CLK.

For example, when the first voltage V1, the second voltage V2, the third voltage V3, and the fourth voltage V4 are about 0 volts, about 1.8 volts, about 3.3 volts, and −1.5 volts, respectively, the peak-to-peak voltage Vpp between the first voltage V1 and the second voltage V2 is about 1.8 volts, the peak-to-peak voltage Vpp between the first voltage V1 and the third voltage V3 is about 3.3 volts, and the peak-to-peak voltage Vpp between the second voltage V2 and the fourth voltage V4 is about 3.3 volts. However, the voltage level of each of the first, second, third, and fourth voltages V1, V2, V3, and V4 may be changed in various ways.

Figure 13:
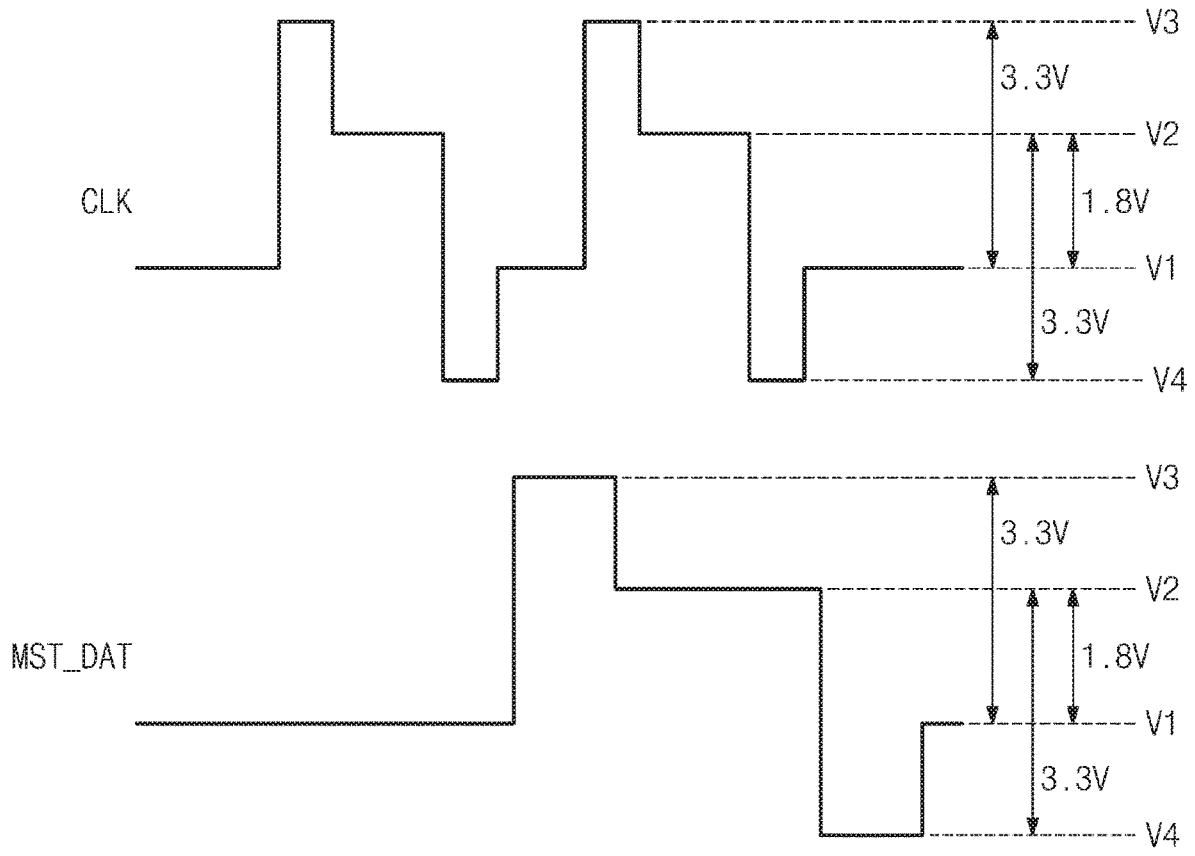
FIG. 13 is a timing diagram showing an example of a clock signal and a master data signal, which are output from the master device shown in FIG. 1.

FIG. 13 is a timing diagram showing an example of a clock signal and a master data signal, which are output from the master device shown in FIG. 1.

Referring to FIG. 13, the master device 110 outputs the third voltage V3 higher than the second voltage V2 having the normal voltage level at the rising edge of the clock signal CLK and then outputs the second voltage V2. That is, the clock signal CLK may be changed to the second voltage V2 from the third voltage V3 during the high level period.

In addition, the master device 110 outputs the fourth voltage V4 lower than the first voltage V1 having the normal voltage level at the falling edge of the clock signal CLK and then outputs the first voltage V1. That is, the clock signal CLK is changed to the first voltage V1 from the fourth voltage V4 during the low level period.

The master device 110 outputs the third voltage V3 higher than the second voltage V2 having the normal voltage level at the rising edge of the master data signal MST_DAT and then outputs the second voltage V2. That is, the master data signal MST_DAT may be changed to the second voltage V2 from the third voltage V3 during the high level period.

In addition, the master device 110 outputs the fourth voltage V4 lower than the first voltage V1 having the normal voltage level at the falling edge of the master data signal MST_DAT and then outputs the first voltage V1. That is, the master data signal MST_DAT is changed to the first voltage V1 from the fourth voltage V4 during the low level period.

Figure 14:
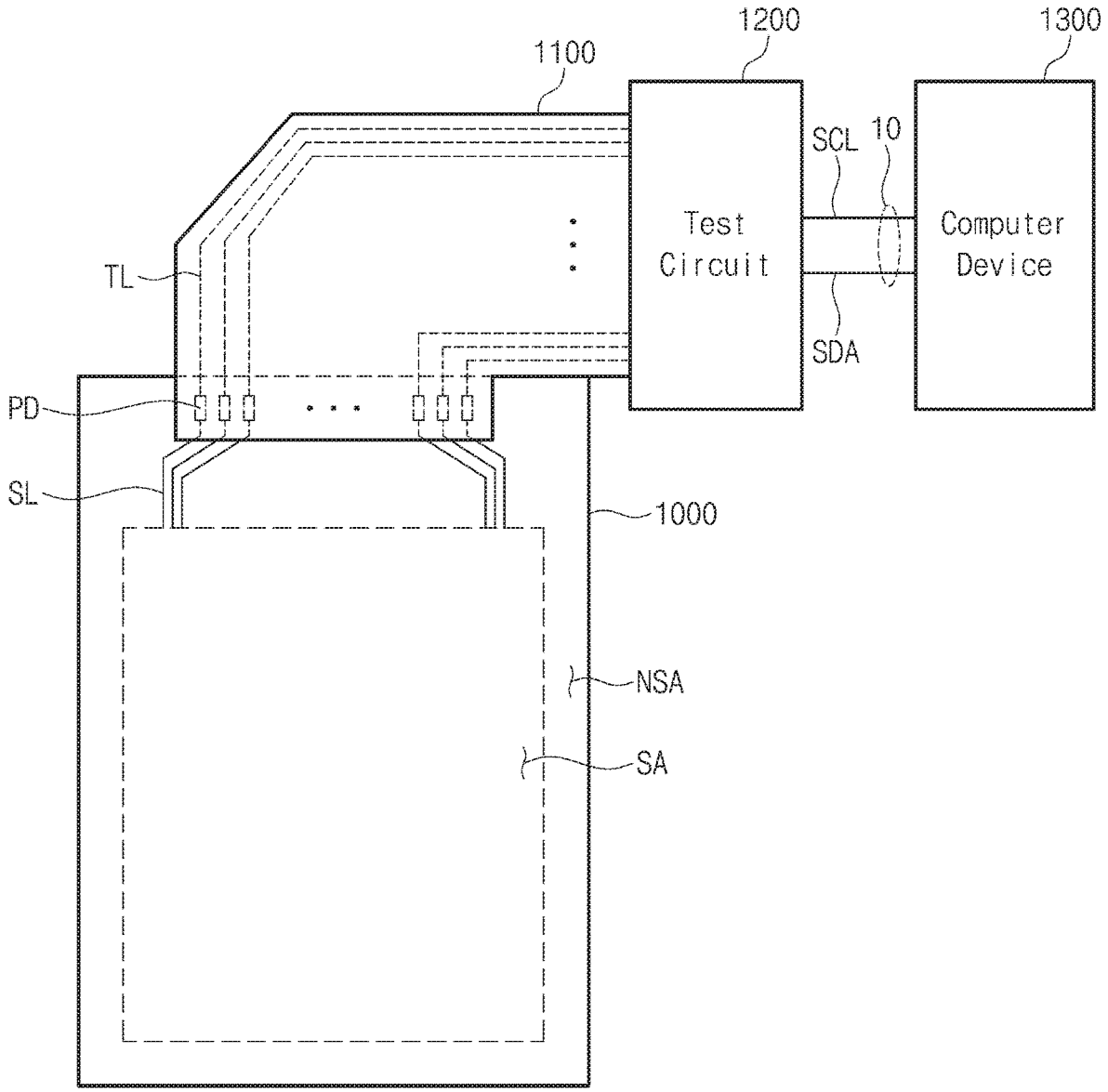
FIG. 14 is a view showing a display device test system according to an exemplary embodiment of the present disclosure.

FIG. 14 is a view showing a display device test system according to an exemplary embodiment of the present disclosure.

Referring to FIG. 14, the test system may test the operation state of a touch panel 1000. The test system includes a connector 1100, a test circuit 1200, and a computer device 1300.

The connector 1100 may be implemented by a flexible printed circuit board on which a plurality of signal lines TL is arranged and may include pads PD arranged on one end thereof. The pads PD may be disposed on a lower surface of the connector 1100.

The connector 1100 may be connected to the touch panel 1000 via the pads PD. In the present exemplary embodiment, the connector 1100 is connected to the touch panel 1000 via the pads PD, however it should not be limited thereto or thereby. According to another embodiment, the connector 1100 may be connected to a display panel (not shown) via the pads PD. In addition, according to another embodiment, the connector 1100 may be connected to other electronic devices via the pads PD.

The touch panel 1000 includes a sensing area SA and a non-sensing area NSA. The non-sensing area NSA is disposed adjacent to the sensing area SA. The non-sensing area NSA may surround an edge of the sensing area. Although not shown in FIG. 14, a plurality of sensing electrodes may be arranged in the sensing area SA. Each of the sensing electrodes may be connected to connection pads (not shown) via signal lines SL. The connection pads of the touch panel 1000 may be electrically connected to the pads PD of the connector 1100.

The test circuit 1200 may output a test signal to the touch panel 1000 via the connector 1100 and may receive a feedback signal from the touch panel 1000. The test circuit 1200 may be implemented by an integrated circuit (IC).

The computer device 1300 may be connected to the test circuit 1200 via an interface 10. The computer device 1300 may output signals to control the test circuit 1200 and may receive a monitoring signal from the test circuit 1200.

The interface 10 that electrically connects the computer device 1300 and the test circuit 1200 may include the data line SDA and the clock line SCL. In the present exemplary embodiment, the computer device 1300 may correspond to the master device 110 shown in FIG. 1, and the test circuit 1200 may correspond to the slave device 121. The computer device 1300 may include the voltage controller 310 and the internal circuit 320, which are shown in FIG. 3.

The signals transmitted and received via the data line SDA and the clock line SCL, which electrically connect the computer device 1300 and the test circuit 1200, may have the signal waveforms as shown in FIGS. 5, 7, and 9 to 13.

Although the exemplary embodiments of the present disclosure have been described, it is understood that the present disclosure should not be limited to these exemplary embodiments but various changes and modifications can be made by one ordinary skilled in the art within the spirit and scope of the present disclosure as hereinafter claimed. Therefore, the disclosed subject matter should not be limited to any single embodiment described herein, and the scope of the present inventive concept shall be determined according to the attached claims.

What is claimed is:

1. A communication device comprising:

a first device connected to a data line and a clock line; and a second device connected to the first device via the data line and the clock line to communicate with the first device, wherein a data signal transmitted to the second device from the first device via the data line swings between a first voltage and a second voltage, the second voltage having a voltage level higher than a voltage level of the first voltage, and a clock signal transmitted to the second device from the first device via the clock line swings between a third voltage higher than the second voltage and the first voltage, the clock signal transmitted to the second device from the first device via the clock line being the third voltage at a rising edge and then changed to the second voltage, wherein the first device comprises:

a voltage controller configured to receive the first voltage, the second voltage, and the third voltage and output a clock high voltage, a data high voltage, a clock low voltage, and a data low voltage in response to a first voltage selection signal; and an internal circuit configured to receive the clock high voltage, the data high voltage, the clock low voltage, and the data low voltage and output the first voltage selection signal, the data signal, and the clock signal.

2. The communication device of claim 1, wherein the internal circuit outputs the data signal that swings between the data high voltage and the data low voltage.

3. The communication device of claim 1, wherein the internal circuit outputs the clock signal that swings between the clock high voltage and the clock low voltage.

4. The communication device of claim 3, wherein the internal circuit sequentially outputs the first voltage selection signal having a first signal level to select the third voltage at a rising edge of the clock signal and the first voltage selection signal having a second signal level to select the second voltage.

5. The communication device of claim 1, wherein the voltage controller comprises:

a first switching transistor comprising a first electrode receiving the second voltage, a second electrode connected to a first node, and a gate electrode receiving the first voltage selection signal;

a first inverter comprising an input terminal receiving the first voltage selection signal and an output terminal; and a second switching transistor comprising a first electrode receiving the third voltage, a second electrode connected to the first node, and a gate electrode connected to the output terminal of the first inverter, and wherein a voltage of the first node is the clock high voltage.

6. The communication device of claim 5, wherein the voltage controller outputs the second voltage as the data high voltage.

7. The communication device of claim 1, wherein the voltage controller outputs the first voltage as the data low voltage and the clock low voltage.

8. The communication device of claim 1, wherein the clock signal transmitted to the second device from the first device via the clock line is transited to a fourth voltage lower than the first voltage at a falling edge and then changed to the first voltage.

9. The communication device of claim 8, wherein the voltage controller further receives the fourth voltage and a second voltage selection signal, and the internal circuit further outputs the second voltage selection signal.

10. The communication device of claim 9, wherein the voltage controller comprises:

a second inverter comprising an input terminal receiving the second voltage selection signal and an output terminal;

a third switching transistor comprising a first electrode receiving the fourth voltage, a second electrode connected to a second node, and a gate electrode connected to the output terminal of the second inverter; and a fourth switching transistor comprising a first electrode receiving the first voltage, a second electrode connected to the second node, and a gate electrode connected to the second voltage selection signal, and wherein a voltage of the second node is the clock low voltage.

11. The communication device of claim 1, wherein the data signal transmitted to the second device from the first device via the data line is transited to the third voltage higher than the second voltage at the rising edge and then changed to the second voltage.

12. The communication device of claim 1, wherein the clock signal transmitted to the second device from the first device via the clock line is transited to a fourth voltage lower than the first voltage at a falling edge and then changed to the first voltage.

13. The communication device of claim 1, wherein the first voltage is about 0 volts, the second voltage is about 1.8 volts, and the third voltage is about 3.3 volts.

14. A test system comprising:

a test circuit configured to test a display panel; and a computer device connected to the test circuit via a data line and a clock line to communicate with the test circuit, wherein a data signal transmitted to the test circuit from the computer device via the data line swings between a first voltage and a second voltage, the second voltage having a voltage level higher than a voltage level of the first voltage, and a clock signal transmitted to the test circuit from the computer device via the clock line swings between a third voltage higher than the second voltage and the first voltage, the clock signal transmitted to the test circuit from the computer device via the clock line being the third voltage at a rising edge and then changed to the second voltage, and wherein the computer device comprises:

a voltage controller configured to receive the first voltage, the second voltage, and the third voltage and outputting a clock high voltage, a data high voltage, a clock low voltage, and a data low voltage in response to a first voltage selection signal; and an internal circuit configured to receive the clock high voltage, the data high voltage, the clock low voltage, and the data low voltage and outputting the first voltage selection signal, the data signal, and the clock signal.

15. The test system of claim 14, wherein the internal circuit outputs the data signal that swings between the data high voltage and the data low voltage and outputs the clock signal that swings between the clock high voltage and the clock low voltage.

16. The test system of claim 14, wherein the internal circuit sequentially outputs the first voltage selection signal having a first signal level to select the third voltage at the rising edge of the clock signal and the first voltage selection signal having a second signal level to select the second voltage.

17. A method of testing a display panel using a test system comprising a first device and a second device connected to the first device to communicate with the first device via a data line and a clock line, the method comprising:

receiving a first voltage, a second voltage, and a third voltage and outputting a clock high voltage, a data high voltage, a clock low voltage and a data low voltage in response to a first voltage selection signal;

receiving the clock high voltage, the data high voltage, the clock low voltage and the data low voltage and outputting the first voltage selection signal, a test data signal and a clock signal;

transmitting the clock signal to the second device from the first device via the clock line; and transmitting the test data signal to the second device from the first device via the data line, wherein the test data signal swings between the first voltage and the second voltage, the second voltage having a voltage level higher than a voltage level of the first voltage, and the clock signal swings between a third voltage higher than the second voltage and the first voltage, the clock signal transmitted to the second device from the first device via the clock line being the third voltage at a rising edge and then changed to the second voltage.

18. The method of claim 17, wherein the clock signal is transited to a fourth voltage lower than the first voltage at a falling edge and then changed to the first voltage.

* * * * *